US005899670A

United States Patent [19]

Ikeda et al.

[11] Patent Number: 5,899,670

[45] Date of Patent: May 4, 1999

[54] INTEGRATED MUFFLER STRUCTURE FOR COMPRESSORS

[75] Inventors: Hayato Ikeda; Satoshi Kitahama; Motonobu Kawakami; Tetsuya Takashima, all of Kariya, Japan

[73] Assignee: Kabushiki Kaisha Toyoda Jidoshokki Seisakusho, Kariya, Japan

[21] Appl. No.: 08/881,249

[22] Filed: Jun. 25, 1997

[30] Foreign Application Priority Data

Aug. 7, 1996 [JP] Japan ..... 8-177895

[51] Int. Cl.[6] ..... F04B 39/00

[52] U.S. Cl. ..... 417/312; 417/269; 417/540

[58] Field of Search ..... 417/269, 312, 417/540

[56] References Cited

U.S. PATENT DOCUMENTS 4,610,604 9/1986 Iwamori ..... 417/312
5,645,405 7/1997 Ota et al. ..... 417/312

FOREIGN PATENT DOCUMENTS 49-25505 3/1974 Japan .
59-135385 9/1984 Japan .

*Primary Examiner*—Charles G. Freay
*Assistant Examiner*—Cheryl J. Tyler
*Attorney, Agent, or Firm*—Morgan & Finnegan, L.L.P.

[57] ABSTRACT

A compressor having a housing formed by joining a plurality of housing components. A plurality of muffler elements are formed integrally with the housing components along the periphery of the housing. A muffler chamber is defined in the housing by coupling the housing components to one another. A large volume chamber and a small volume chamber are defined in the muffler chamber and connected to each other. An inlet is provided in at least one of the muffler elements for drawing the gas in the discharge chamber into the large volume chamber. An outlet is provided in the muffler elements for discharging the gas in the small volume chamber into the external circuit. The arrangement and construction of the housing is such that the pressure pulses in the discharge gas are reduced, and thus vibration and noise are reduced.

11 Claims, 3 Drawing Sheets

INTEGRATED MUFFLER STRUCTURE FOR COMPRESSORS

BACKGROUND OF THE INVENTION

1. Field of the Invention

The present invention relates to compressors incorporated in, for example, vehicle air-conditioning systems, and more particularly, to structure of mufflers for compressors.

2. Description of the Related Art

Compressors having a suction muffler in a suction gas passage or in a discharge gas passage are known in the prior art. The muffler includes a space used to reduce pulsation components of the suction gas or the discharge gas. The pulsation components are reflected to cause mutual interference between one another. This decreases vibrations and noise that result from the pulsation.

Japanese Unexamined Utility Model Publication No. 59-135385 describes a compressor that is provided with a typical muffler structure. The compressor has a housing that houses a compressing mechanism. A muffler chamber is defined between a recess, which is provided in the peripheral portion of the housing, and a cover, which is a component independent from the housing and which seals the recess. However, in this prior art example, the housing and the separate cover must be provided to define the muffler chamber. Accordingly, this increases the number of parts required to constitute the muffler and increases the number of assembly steps. Thus, the structure of this muffler resulted in an increase in the production cost of the compressor.

Furthermore, the muffler chamber of the above compressor causes the reflection and interference of the pulsation components of the suction gas or the discharge gas to be monotonous. Thus, the reduction of the gas pulsation is inefficient.

SUMMARY OF THE INVENTION

Accordingly, it is an objective of the present invention to provide a compressor muffler structure having fewer components while more efficiently reducing pulsation of refrigerant gas.

To achieve the above objective, the present invention provides a compressor including a gas compressing mechanism accommodated in a housing formed by joining a plurality of housing components. The compressing mechanism has a suction chamber for drawing in gas from an external circuit, a compression chamber for compressing the drawn in gas, and a discharge chamber for temporarily containing the compressed gas before discharging the gas into the external circuit. The compressor performs suction, compression, and discharge of gas in accordance with movement of the compressing mechanism. The compressor further includes a plurality of muffler elements formed integrally with the housing components on the periphery of the housing. A muffler chamber is defined by the muffler elements when the housing components are joined to one another. A large volume chamber and a small volume chamber is defined in the muffler chamber. The large and small volume chambers communicate with each other. An inlet is provided in at least one of the muffler elements for drawing the gas in the discharge chamber into said large volume chamber. An outlet is provided in the muffler elements for discharging the gas in the small volume chamber into the external circuit.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
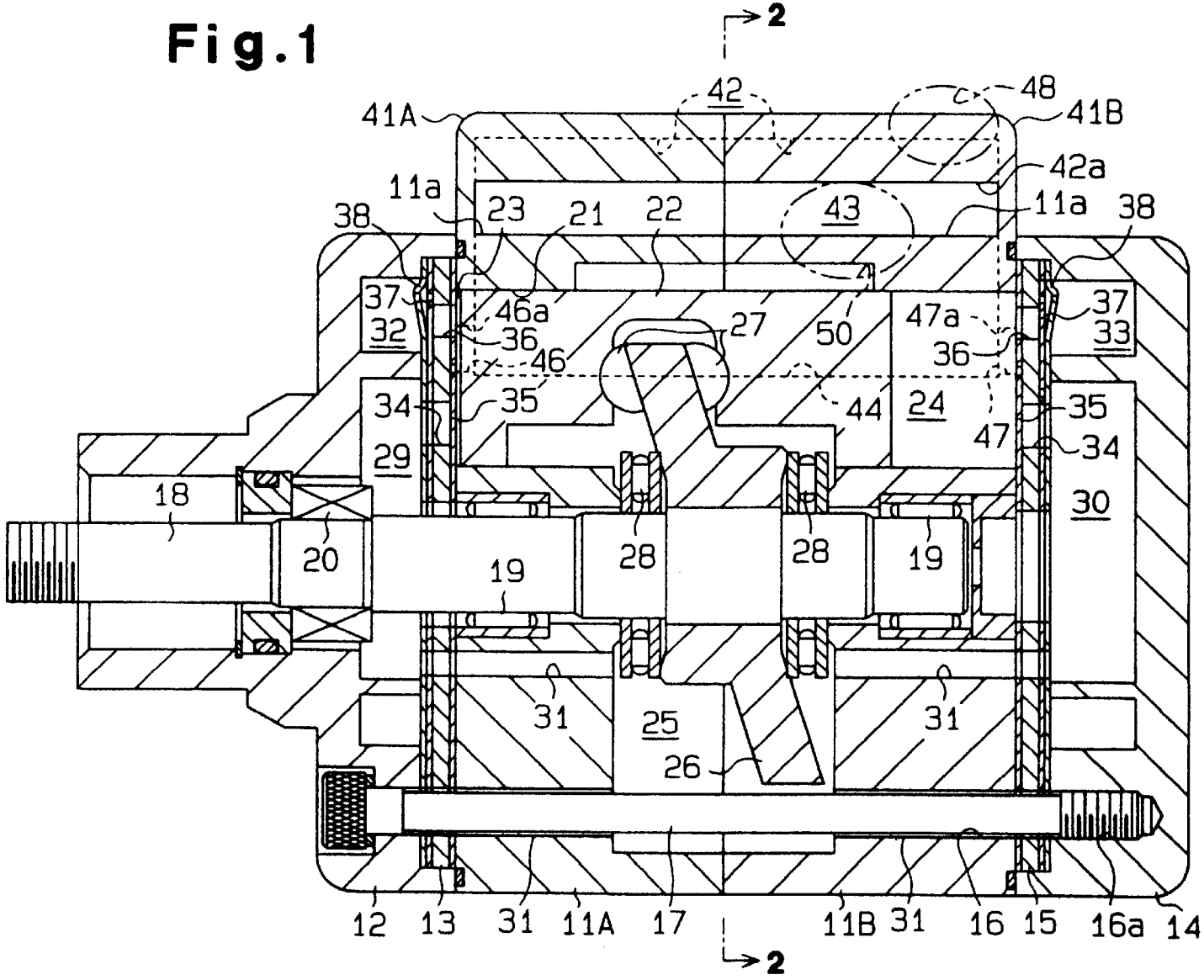
FIG. 1 is a cross-sectional view showing a double-headed piston type compressor provided with a muffler structure according to the present invention.

One embodiment of a muffler structure for a double-headed piston type compressor according to the present invention will now be described with reference to the drawings. As shown in FIG. 1, a pair of cylinder blocks 11A, l1B, which serve as housing components, are coupled to each other. A front housing 12, also serving as housing component, is coupled to the front end of the cylinder block 11A with a front valve plate 13 arranged in between. In the same manner, a rear housing 14, also serving as a housing component, is coupled to the rear end of the cylinder block 11B with a rear valve plate 15 arranged in between.

A plurality of bolt holes 16 extend between the front housing 12 and the rear housing 14. Each bolt hole 16 extends through the front housing 12, the front valve plate 13, the cylinder blocks 11A, 11B, the rear valve plate 15, and the rear housing 14. A bolt 17 is inserted into each bolt hole 16 from the front housing 12 and screwed into a threaded hole 16a provided in the rear housing 14. Thus, the bolts 17 fasten the cylinder blocks 11A, 11B to each other.

A drive shaft 18 is rotatably supported by a pair of radial bearings 19. A lip seal 20 is arranged between the periphery of the front end of the drive shaft 18 and the front housing 12. The drive shaft 18 is operably connected to an external drive source such as a vehicle engine by a clutch mechanism (not shown). Connection of the clutch mechanism transmits the drive force of the external drive source to the drive shaft 18.

Figure 2:
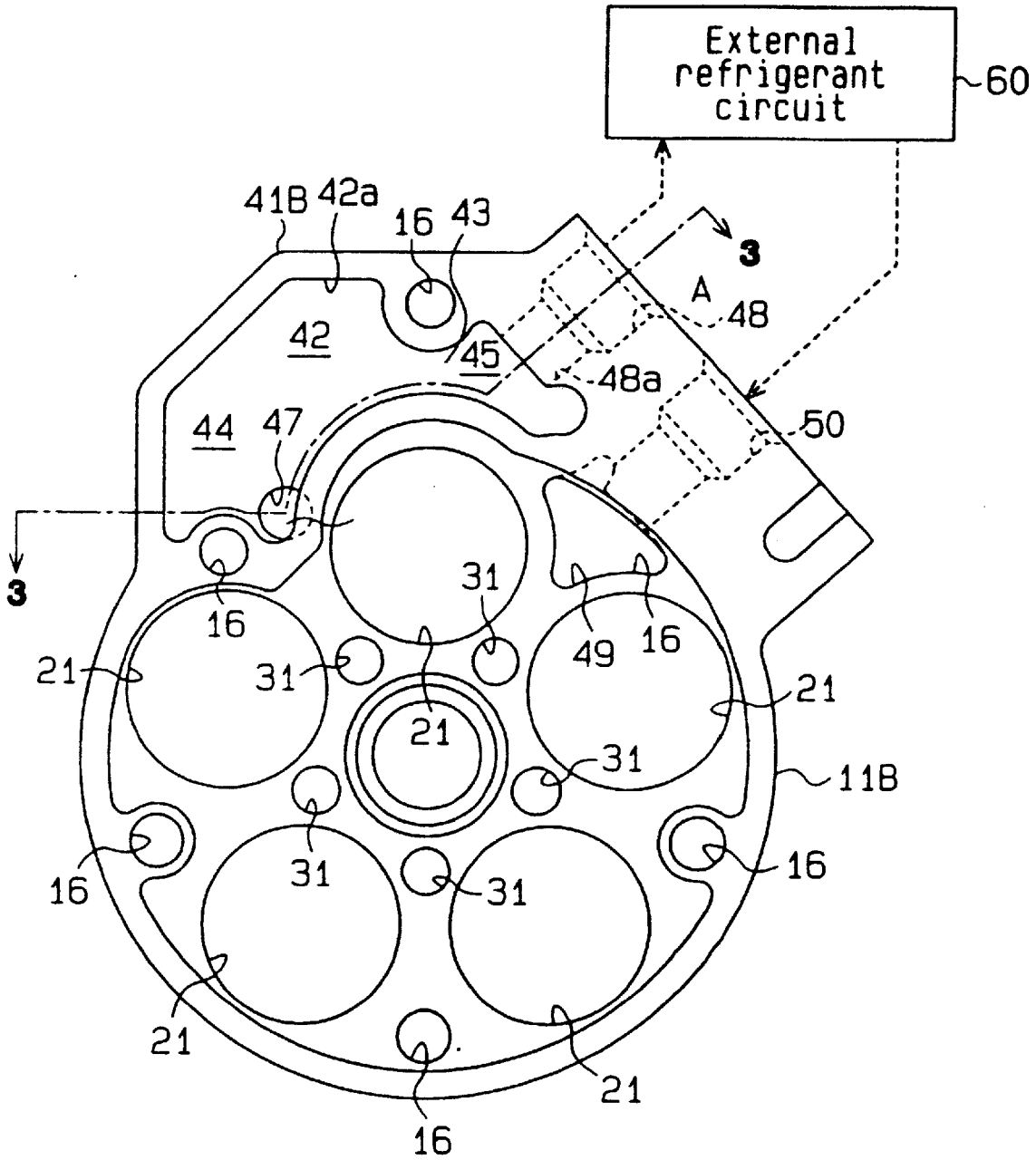
FIG. 2 is a side view showing the rear cylinder block taken along line 2—2 in FIG. 1.

As shown in FIG. 2, a plurality of cylinder bores 21 extend through the cylinder blocks 11A, 11B parallel to the axis of the drive shaft 18. The cylinder bores 21 are spaced equally from one another along a circle that is coaxial with the drive shaft 18. A double-headed piston 22 is reciprocally accommodated in each cylinder bore 21. In each cylinder bore 21, a front compression chamber 23 is defined between a front head of the piston 22 and the associated front valve plate 13, while a rear compression chamber 24 is defined between the rear head of the piston 22 and the associated rear valve plate 15.

A crank chamber 25 is defined between the cylinder blocks 11A, 11B. A swash plate 26 is fixed to the drive shaft 18 in the crank chamber 25. The peripheral portion of the swash plate 26 is connected to the middle of each piston 22 by means of shoes 27. The rotation of the drive shaft 18 causes the swash plate 26 to reciprocate each piston 22. A pair of thrust bearings 28 are arranged between the front side of the swash plate 26 and the cylinder block 11A and between the rear side of the swash plate 26 and the cylinder block 11B. As shown in FIG. 2, the crank chamber 25 is connected to an external refrigerant circuit 60 by an intake passage 49 and a suction port 50.

A front suction chamber 29 is defined in the center portion of the front housing 29, while a rear suction chamber 30 is defined in the center portion of the rear housing 14. A plurality of suction passages 31 extend through the cylinder blocks 11A, 11B and connect the front and rear suction chambers 29, 30 to the crank chamber 25. An annular front discharge chamber 32 is defined in the peripheral portion of the front housing 12, while an annular rear discharge chamber 33 is defined in the peripheral portion of the rear housing 14.

A plurality of suction ports 34 extend through the valve plates 13, 15 in correspondence with the cylinder bores 21. A suction valve 35 is provided for each suction port 34 in the valve plates 13, 15. Each suction valve 35 selectively opens and closes the associated suction port 34. Each suction valve 35 is opened when the associated piston 22 moves from the top dead center position to the bottom dead center position. This draws refrigerant gas into the compression chamber 23, 24 from the associated suction chambers 29, 30.

A plurality of discharge ports 36 extend through the valve plates 13, 15 in correspondence with the cylinder bores 21. A discharge valve 37 is provided for each discharge port 34 in the valve plates 13, 15. Each discharge valve 37 selectively opens and closes the associated discharge port 36. The discharge valve 37 is opened as the pressure within the associated compression chamber 23, 24 reaches a predetermined value when the piston 22 moves from the bottom dead center position to the top dead center position. This releases the refrigerant gas into the associated discharge chambers 32, 33. A retainer 38 is adhered to each valve plate 13, 15 to restrict the angle of the associated discharge valves 37 when opened.

The muffler structure of the double-headed piston type compressor will now be described.

Figure 3:
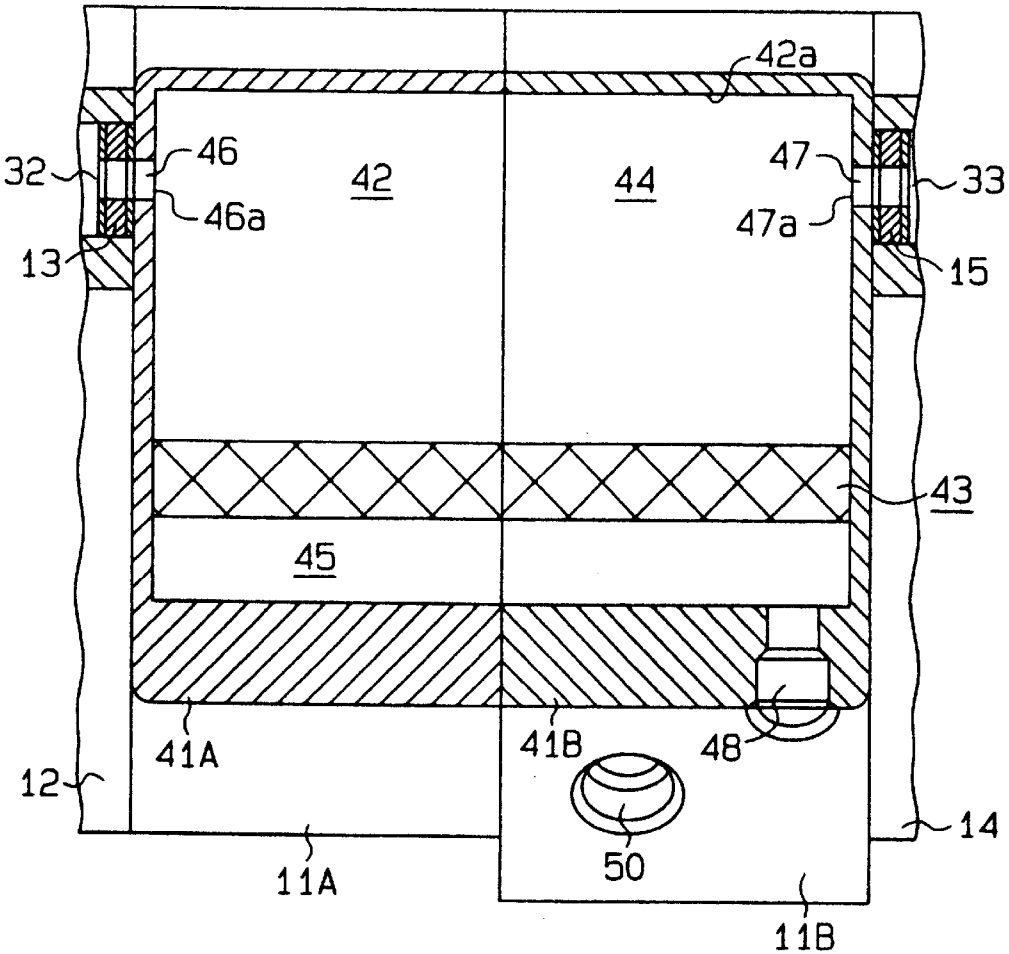
FIG. 3 is a cross-sectional view taken along line 3—3 in FIG. 2.

As shown in FIGS. 1 to 3, a front projecting portion 41A, which serves as a muffler element, projects from the periphery of the front cylinder block 11A. The front projecting portion 41A is formed integrally with the front cylinder block 11A. A rear projecting portion 41B, which also serves as a muffler element, projects from the periphery of the rear cylinder block 11B. The rear projecting portion 41B is formed integrally with the rear cylinder block 11B. The front and rear projecting portions 41A, 41B are joined to each other when the cylinder blocks 11A, 11B are coupled together. A muffler chamber 42 is defined by the projecting portions 41A, 41B. When the cylinder block 11A and the projecting portion 41A are joined with the cylinder block 11B and the projecting portion 41B, the muffler chambers 42 are connected to each other and sealed. Accordingly, the muffler chambers 42 form a single, integral space.

Part of an inner wall 42a of the muffler chamber 42 protrudes inward and defines a throttle portion 43 in the muffler chamber 42. The throttle portion 43 partitions the muffler chamber 42 into a large volume chamber 44, and a small volume chamber 45. As shown in FIG. 3, the throttle portion 43 extends across the entire muffler chamber 42 in the axial direction of the compressor. The throttle portion 43 restricts the flow rate of the discharge gas as the gas flows into the small volume chamber 45 from the large volume chamber 44.

An inlet 46 extending through the valve plate 13 and the cylinder block 11A communicates the discharge chamber 32 with the large volume chamber 44. An inlet 47 extending through the valve plate 15 and the cylinder block 11B communicates the discharge chamber 33 with the large volume chamber 44. The inlets 46, 47 respectively have ports 46a, 47a that are connected to the large volume chamber 44 and that face toward each other in the large volume chamber 44.

An outlet 48 is provided in the rear projecting portion 41B to connect the small volume chamber 45 to the external refrigerant circuit 60. Accordingly, the distance between the port 46*a* of the inlet 46 and a port 48*a* of the outlet 48 differs from the distance between the port 47*a* of the inlet 47 and the port 48*a* of the outlet 48. In this embodiment, the distance between the port 46*a* of the inlet 46 and the port 48*a* of the outlet 48 is longer than the distance between the port 47*a* of the inlet 47 and the port 48*a* of the outlet 48.

When the clutch mechanism is operated to transmit the drive force of the external drive source to the drive shaft 18, the drive shaft 18 rotates the swash plate 26 and reciprocates the piston 22. This draws the refrigerant gas into the compression chambers 23, 24 from the suction chambers 29, 30. After compression, the refrigerant gas is discharged into the associated discharge chamber 32, 33.

The discharge gas flows into the large volume chamber 44 of the muffler chamber 42 by way of the inlets 46, 47. The gas in the large volume chamber 44 flows into the small volume chamber 45 after the throttle portion 43 restricts its flow rate. The gas is then sent to the external refrigerant circuit 60 by way of the outlet 48.

As the discharge gas passes through the muffler chamber 42, discharge gas pressure pulses are reflected by the inner wall 42*a* of the muffler chamber 42, and there is interference between different components of the pressure pulses. Accordingly, the pressure pulsation of the discharge gas is reduced before the gas is sent out to the external refrigerant circuit 60 from the outlet 48.

The advantageous effects described below are obtained through this embodiment.

The projecting portions 41A, 41B are formed integrally with the periphery of the cylinder blocks 11A, 11B. The muffler chamber 42 is defined by both portions 41A, 41B and sealed by joining the cylinder blocks 11A, 11B. Accordingly, separate parts, other than the cylinder blocks 11A, 11B, are not required to form the muffler chamber 42. This decreases the number of parts that constitute the muffler structure and decreases the number of assembly steps. This reduces the production costs of the compressor.

The discharge gas first flows into the large volume chamber 44 and then flows into the small volume chamber 45 by way of the throttle portion 43. This increase the time period during which the discharge gas remains in the large and small volume chambers 44, 45. This enables efficient reflection and interference of the discharge gas pulses. Accordingly, the pulsation, or pressure fluctuation, of the gas that flows out of the muffler chamber 42 is decreased.

If, for example, the structure of the muffler is reversed from the above embodiment, that is, if the discharge gas first enters the small volume chamber and then flows out from the large volume chamber, the gas is first throttled by the small volume chamber. The gas then flows freely into and out of the large volume chamber. In this case, the throttling effect of the large volume chamber is small. Thus, the time period during which the gas remains in the muffler chamber becomes shorter. This hinders effective reflection and interference of the discharge gas pulses.

The throttle portion 43 is formed by projecting a portion of the inner wall 42*a* of the muffler chamber 42 inward into the muffler chamber 42. This structure reduces the number of components in comparison with a structure having the throttle portion 43 formed by a separate body.

In the muffler chamber 42, the distance between the port 46*a* of the inlet 46 and the port 48*a* of the outlet 48 differs from the distance between the port 47*a* of the inlet 47 and the port 48*a* of the outlet 48. Accordingly, reflection and interference of the pulses of the discharge gas in the muffler chamber 42 are carried out effectively.

The port 46*a*, through which the discharge gas enters the large volume chamber 44 from the front discharge chamber 32, and the port 47*a*, through which the discharge gas enters the large volume chamber 44 from the rear discharge chamber 33, face toward each other. Thus, pulses in the gas that flows into the large volume chamber 44 from the port 46*a* collide with pulses in the gas that flows into the large volume chamber 44 from the port 47*a*. As a result, the pulses of the gas flowing from the port 46*a* and from the port 47*a* interfere with one another. This effectively reduces pressure fluctuation of the discharge gas.

Although only one embodiment of the present invention has been described so far, it should be apparent to those skilled in the art that the present invention may be embodied in many other specific forms without departing from the spirit or scope of the invention. More particularly, the present invention may be embodied in the modes described below.

The present invention may be embodied in a muffler that reduces the pulsation of the suction gas instead of a muffler that reduces the pulsation of the discharge gas. The present invention may also be embodied in both suction gas and discharge gas mufflers. This reduces pulsation of the suction gas and decreases vibrations and noise caused by the pulsation.

The muffler chamber 42 may consist of three or more spaces. In this case, it is preferable that the space at the downstream side have a volume that is smaller than the space at the upstream side.

The muffler chamber 42 may be provided in only one of either the front projecting portion 41A or the rear projecting portion 41B. In such a construction, a cover that seals the opening of the muffler chamber 42 may be formed integrally with the other projecting portion 41B, 41A. Furthermore, a muffler structure similar to that of the illustrated embodiment may span the front housing 12 and the front cylinder block 11A or the rear cylinder block 11B and the rear housing 14.

A muffler structure similar to that of the illustrated embodiment may extend from the front housing 12 to the rear cylinder block 11B. As another option, the muffler structure may extend from the front cylinder block 11A to the rear housing 14. The muffler structure may also extend from the front housing 12 to the rear housing 14.

The muffler structure according to the present invention may be embodied in a single-headed piston type compressor or a compressor that employs a cam plate, such as a so-called wave cam, in lieu of the swash plate. The muffler structure according to the present invention may also be embodied in a vane type compressor or a scroll type compressor.

Therefore, the present examples and embodiments are to be considered as illustrative and not restrictive and the invention is not to be limited to the details given herein, but may be modified within the scope of the appended claims.

What is claimed is:

1. A compressor including a gas compressing mechanism accommodated in a housing formed by joining a plurality of housing components, said compressing mechanism having a suction chamber for drawing in gas from an external circuit, a compression chamber for compressing the drawn in gas, and a discharge chamber for temporarily containing the compressed gas before discharging the gas into the external circuit, wherein said compressor performs suction, compression, and discharge of gas in accordance with movement of the compressing mechanism, said compressor further comprising:

a plurality of muffler elements formed integrally with the housing components on the periphery of the housing;

a muffler chamber defined by the muffler elements when the housing components are joined to one another;

a large volume chamber and a small volume chamber defined in said muffler chamber, wherein said large and small volume chambers communicate with each other;

an inlet provided in at least one of the muffler elements for drawing the gas in the discharge chamber into said large volume chamber; and an outlet provided in said muffler elements for discharging the gas in said small volume chamber into the external circuit.

2. The compressor according to claim 1, wherein said muffler elements include a throttle portion for restricting the flow rate of the gas between said large volume chamber and said small volume chamber.

3. The compressor according to claim 2, wherein said muffler elements include a wall, and wherein said throttle portion is defined by a protrusion in said wall that extends into the muffler chamber.

4. The compressor according to claim 1, wherein said compressing mechanism further includes:

a plurality of cylinder bores defined in the housing;

a piston reciprocally accommodated in each cylinder bore, said piston having a front head and a rear head;

a front discharge chamber;

a plurality of front compression chambers adjacent to the front head of each piston, wherein the front compression chambers are located between the front head and the housing;

a front valve plate for defining a front suction chamber, said front valve plate having a plurality of valves for controlling the flow of gas between the front suction chamber and the front compression chambers and between the front compression chambers and the front discharge chamber; and a plurality of rear compression chambers adjacent to the rear head of each piston and located between the rear head and the housing, a rear valve plate for defining a rear suction chamber and a rear discharge chamber, said rear valve plate having a plurality of valves for controlling the flow of gas between the rear suction chamber and the rear compression chambers and between the rear compression chambers and the rear discharge chamber.

5. The compressor according to claim 4, wherein said inlet is a front inlet for connecting said large volume chamber with said front discharge chamber, said front inlet having a port connected to said large volume chamber; and wherein said compressor further includes a rear inlet for connecting said large volume chamber with said rear discharge chamber, said rear inlet having a port connected to said large volume chamber;

wherein said outlet includes a port connected with said small volume chamber; and wherein the distance between the port of said front inlet and the port of said outlet is different than the distance between the port of said rear inlet to the port of said outlet.

6. The compressor according to claim 5, wherein the port of said front inlet faces toward the port of said rear inlet.

7. A compressor including a plurality of cylinder bores arranged about a drive shaft in a housing formed by joining a plurality of housing components, a double-headed piston accommodated in each cylinder bore, said double-headed piston being reciprocated by rotation of a cam body fitted on a drive shaft for drawing gas from an external circuit into a front compression chamber formed adjacent to a front end of the double-headed piston and a rear compression chamber formed adjacent to a rear end of the double-headed piston, wherein the piston compresses the drawn in gas in the compression chambers, and front and rear discharge chambers for temporarily containing the compressed gas before discharging the gas into the external circuit, said compressor further comprising:

a plurality of muffler elements formed integrally with the housing components on the periphery of the housing;

a muffler chamber defined by the muffler elements when the housing components are joined to one another;

a large volume chamber and a small volume chamber defined in said muffler chamber, wherein said large and small volume chambers communicate with each other;

an inlet provided in at least one of the muffler elements for drawing the gas in the discharge chamber into said large volume chamber; and an outlet provided in said muffler elements for discharging the gas in said small volume chamber into the external circuit.

8. The compressor according to claim 7, wherein said muffler elements include a throttle portion for restricting the flow rate of the gas between said large volume chamber and said small volume chamber.

9. The compressor according to claim 8, wherein said muffler elements include a wall, and wherein said throttle portion is defined by a protrusion in said wall that extends into the muffler chamber.

10. The compressor according to claim 7, wherein said inlet is a front inlet for connecting said large volume chamber with said front discharge chamber, said front inlet having a port connected to said large volume chamber; and wherein said compressor further includes a rear inlet for connecting said large volume chamber with said rear discharge chamber, said rear inlet having a port connected to said large volume chamber;

wherein said outlet includes a port connected with said small volume chamber; and wherein the distance between the port of said front inlet and the port of said outlet is different than the distance between the port of said rear inlet to the port of said outlet.

11. The compressor according to claim 10, wherein the port of said front inlet faces toward the port of said rear inlet.

* * * * *

UNITED STATES PATENT AND TRADEMARK OFFICE

CERTIFICATE OF CORRECTION

PATENT NO. : 5,899,670

DATED : May 4, 1999

INVENTOR(S) : Hayato IKEDA et al

It is certified that error appears in the above-identified patent and that said Letters Patent is hereby corrected as shown below:

On the Cover Page:

Item [30] Foreign Application Priority Data
Change "Aug. 7, 1996" to "July 8, 1996"

Signed and Sealed this

Twenty-seventh Day of June, 2000

*Attest:*

Q. TODD DICKINSON

*Attesting Officer*

*Director of Patents and Trademarks*